US008733000B1

(12) United States Patent
Thakker

(10) Patent No.: US 8,733,000 B1
(45) Date of Patent: May 27, 2014

(54) ADVERTISEMENT DISPLAY AND METHOD OF USE

(71) Applicant: Sanjay Thakker, Edison, NJ (US)

(72) Inventor: Sanjay Thakker, Edison, NJ (US)

( * ) Notice: Subject to any disclaimer, the term of this patent is extended or adjusted under 35 U.S.C. 154(b) by 0 days.

(21) Appl. No.: 13/908,986

(22) Filed: Jun. 3, 2013

Related U.S. Application Data

(60) Provisional application No. 61/654,244, filed on Jun. 1, 2012.

(51) Int. Cl.
*G09F 15/00* (2006.01)
*G09F 1/12* (2006.01)

(52) U.S. Cl.
CPC ..... *G09F 1/12* (2013.01); *G09F 15/0012* (2013.01)
USPC ..... 40/606.15; 40/606.18

(58) Field of Classification Search
CPC ..... G09F 7/22; G09F 1/12; G09F 15/0087; A47G 1/065; A47G 1/14; A47G 1/10; A47F 5/02; A47F 5/05; A47B 97/04
USPC ..... 40/492, 484, 611.02, 606.15, 611.03, 40/611.04, 611.06, 606.18, 606.14, 530, 40/531, 482, 493, 723, 734; 211/47, 163, 211/169
See application file for complete search history.

(56) References Cited

U.S. PATENT DOCUMENTS

| | | | | |
|---|---|---|---|---|
| 1,934,532 | A * | 11/1933 | Hallowell et al. | 40/611.04 |
| 3,468,039 | A * | 9/1969 | Dubbert | 434/429 |
| 5,694,881 | A * | 12/1997 | Creech | 116/222 |
| 6,112,445 | A * | 9/2000 | Feeney | 40/747 |
| 2012/0174449 | A1 * | 7/2012 | Pitcher et al. | 40/606.01 |

* cited by examiner

*Primary Examiner* — Casandra Davis
(74) *Attorney, Agent, or Firm* — Lawrence G. Fridman

(57) ABSTRACT

An advertisement display formed with two side columns with at least one advertisement module provided therebetween. The module consists of a top unit and a pivoting lower unit. The top unit is slidable within the side columns. A longitudinal wall is spaced from a bottom wall of the top unit defining a utility space therebetween. The lower unit is locked and prevented from pivoting when the top unit with the longitudinal wall is slid into a downward position, and is allowed to pivot when the top unit with the longitudinal wall is slid upwardly unlocking the bottom unit.

15 Claims, 7 Drawing Sheets

ADVERTISEMENT DISPLAY AND METHOD OF USE

REFERENCE TO RELATED APPLICATION

This Application claims priority of U.S. Provisional Application Ser. No. 61/654,244 filed by the inventor on Jun. 1, 2012, the entire disclosure of which is hereby incorporated by reference.

FIELD OF THE INVENTION

The present invention relates generally to devices used in the field of advertisement, and more specifically it relates to display signs, so that the advertisements can be changed frequently and easily to accommodate new messages.

BACKGROUND OF THE INVENTION

Many businesses such as gasoline service stations, fast food outlets, quick-stop or convenience stores, theaters, and other such businesses often display advertisement about their products, services, and prices on outdoor display signs near the places of business. A substantial number of such signs are in use nationally in all variety of applications for businesses large and small.

The information on the signs is often changed based on updates in market conditions, competition, and the products or services that are marketed by the business establishment. The price digits on gas station signs, the list of "specials" at convenience stores, all are examples of changeable graphics. Various devices have been used to accomplish the process of changing the information on the signs.

Prior art free standing gas price signs are typically formed with a metal frame with aluminum panel, having numbers hinging at the center of each number flipping upward or downward. Once the numbers are flipped, they are held in place with metal binding clips. Such signs are often formed with two or three digit arrangement capable of being flipped upward or downward to accommodate changing in prices. One of the drawbacks of such design is that the numbers in the display are exposed and accessible to unauthorized personnel without restrictions. Further more, such signs have substantial limitations for modifications and are difficult operate in extreme conditions or often require excessive amounts of time and labor to maintain or refurbish. The prior art advertisement signs often require a spring loaded bottom to withstand windy conditions, so the sign can bend backward and forward.

Thus, it has been a long-felt and unsolved need to provide a module-type advertisement display capable of accommodating a plurality of applications. The display which is easy and inexpensive to produce and safe to operate. There is also a need for an advertisement display in which advertising messages can be efficiently changed, and having critical interior elements protected from undesirable environmental conditions. There is a further need for an advertisement display where consumer/operator has the ability to marginally replace elements of the display to accommodate a particular need.

SUMMARY OF THE INVENTION

One of the primary objects of the present invention is, to simplify changing the characters or numbers on a display.

It is another object of the invention to enable the characters on a display to be changed without requiring additional equipment, components, character elements, etc. to be brought to the display in order that the change in the characters might be effected.

It is a further object of the invention to securely hold elements of a multi-element character in proper positions for displaying a particular character and for also permitting the elements of the character to be easily changed as desired.

One aspect of the invention provides an advertisement display including first and second side columns spaced from each other to define an operational space therebetween. At least one advertisement module is provided within the operational space. The module has a slidable top unit and a pivoting bottom unit. The top unit is adapted for slidable movement within the operational space and is formed with front, rear and side walls supported by a bottom wall. A longitudinal wall is spaced from the bottom wall of the top unit, so as to define a utility space therebetween. The pivoting bottom unit is formed by at least front and rear exterior panels interconnected by first and second side panels, so as to form an open upper area.

As to another aspect of the invention, the longitudinal wall slides with the top unit within the operational space, so as to engage and disengage the upper area of the pivoting unit. The longitudinal wall in the lower position of the top unit locks and covers the interior of the pivoting unit, when it is vertically oriented within the operational space. For the pivoting to occur, the lower unit is disengaged by sliding the longitudinal wall along with the top unit upwardly. The lower unit of the module is locked and prevented from pivoting, when the upper unit with the longitudinal wall are slid into the downward position.

A further aspect of the invention provides a method of operation of an advertisement display. The display consists of a first and second side column spaced from each other defining an operational space therebetween. At least one advertisement module is provided within the operational space and comprises a slidable top unit and a pivoting bottom unit. The top unit is adapted for slidable movement within the operational space and is formed by at least front and rear walls supported by a bottom wall. A longitudinal wall is spaced from the bottom wall, so as to define a utility space therebetween. The pivoting bottom unit is formed by at least front and rear exterior panels interconnected by first and second side panels defining an open upper area.

The method comprises the steps of sliding the top unit within the operational space along the first and second columns; pivoting the bottom unit relative to the first and second side columns. Upon sliding the top unit to its lower slid position, the longitudinal wall engages the open upper area of the bottom unit, so as to close the interior of the pivoting unit and to prevent pivotal motion thereof relative to the side columns. Upon slidable motion of the top unit in the upward direction, the longitudinal wall disengages the open upper area of the bottom unit, so as to facilitate pivotal motion of the bottom unit relative the side columns.

BRIEF DESCRIPTION OF THE DRAWINGS

Referring now to the drawings which are provided to illustrate and not to limit the invention, wherein.

DETAILED DESCRIPTION OF THE INVENTION

Figure 1:
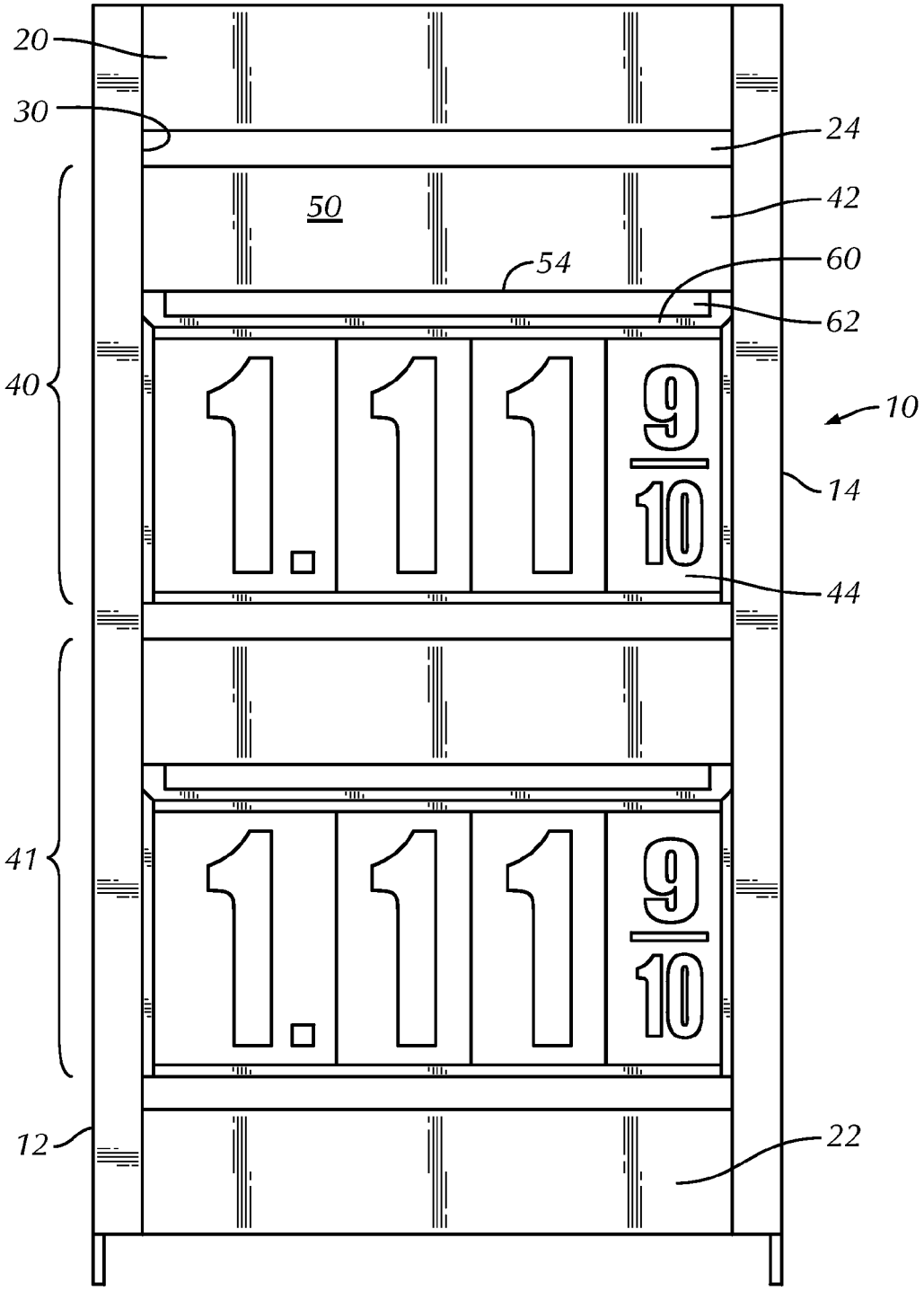
FIG. 1 is a front elevational view of an advertisement display of the invention in an assembled condition.
Figure 2:
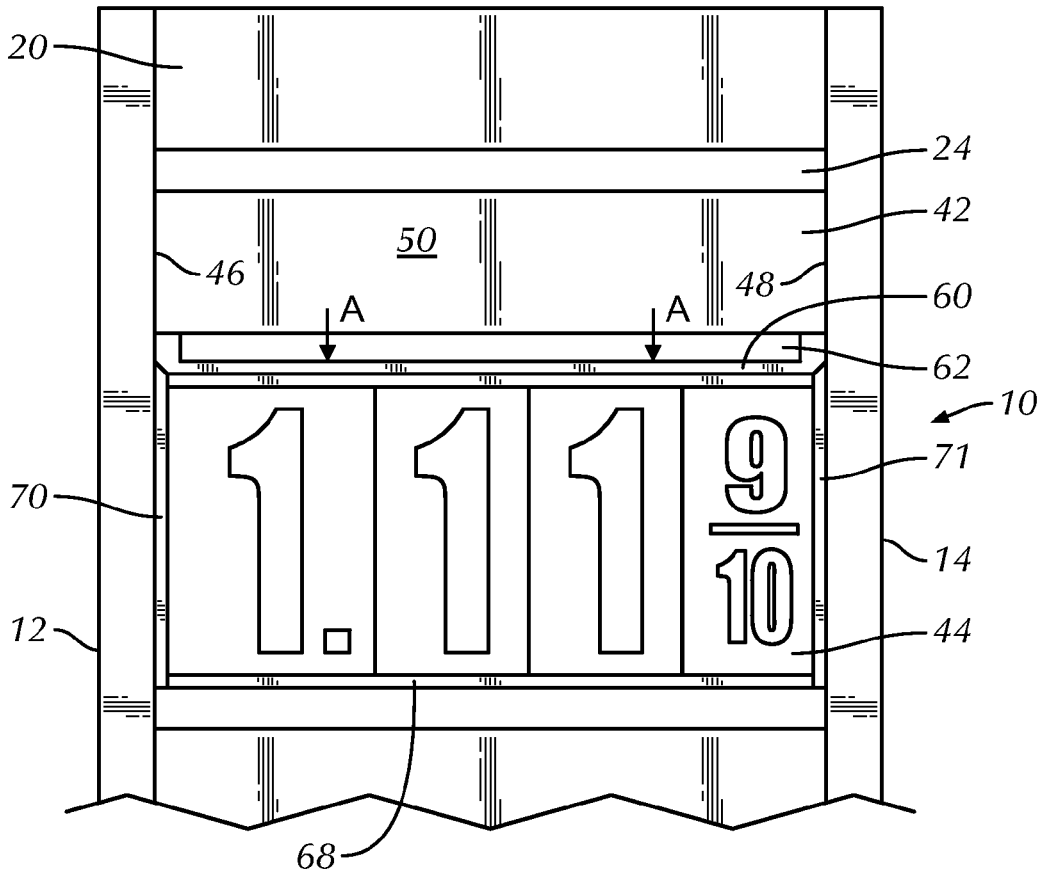
FIG. 2 is a partial front elevational view of the display showing a top sliding unit in a downward position engaging a bottom pivoting unit of a module.
Figure 3:
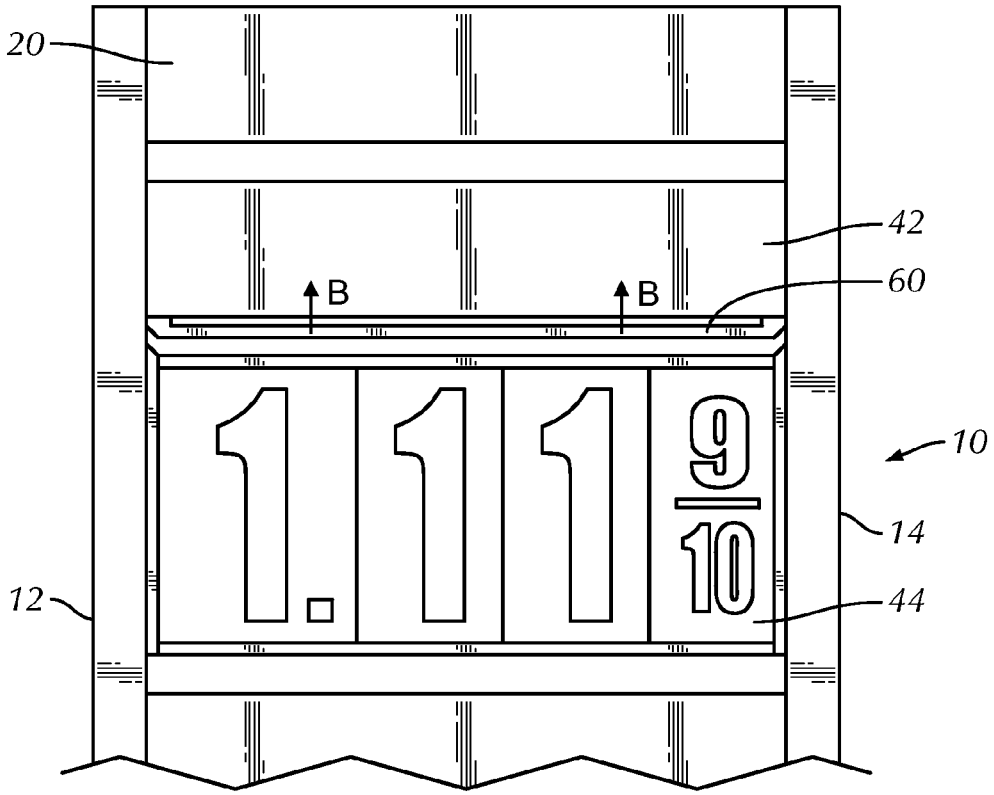
FIG. 3 is a view similar to that of FIG. 2, but showing the sliding unit in an upward position separated from the pivoting unit of the module.
Figure 4:
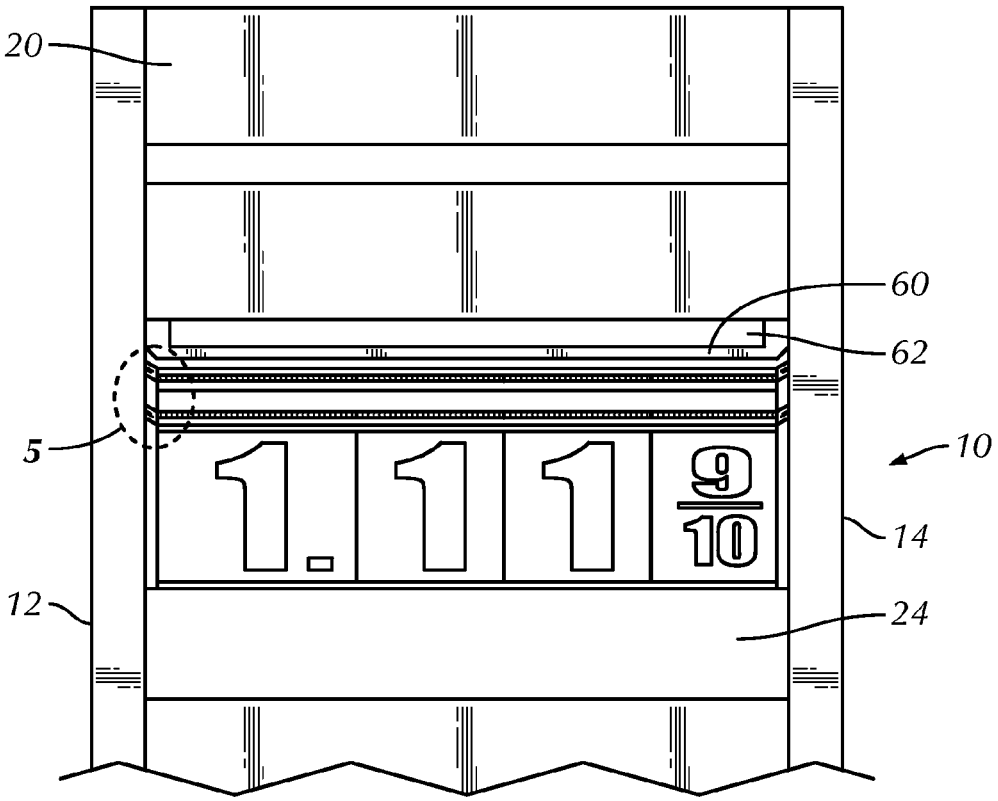
FIG. 4 is a partial elevational view of the display.

Referring now to the drawings, wherein there is shown in at least FIGS. 1-4, an advertisement display 10 constructed in accordance with the principles of the present invention.

The display 10 of the invention is formed with two support columns 12 and 14 spaced from each other and interconnected by upper and lower connecting units 20 and 22. The connecting units are attached to the columns, so as to keep the display together and to enhance strength and stability of the entire assembly. In this manner, an operational space 24 is defined between the inner surfaces 30 of the side columns and inner surfaces of the upper and lower connecting units 20 and 22.

Figure 9:
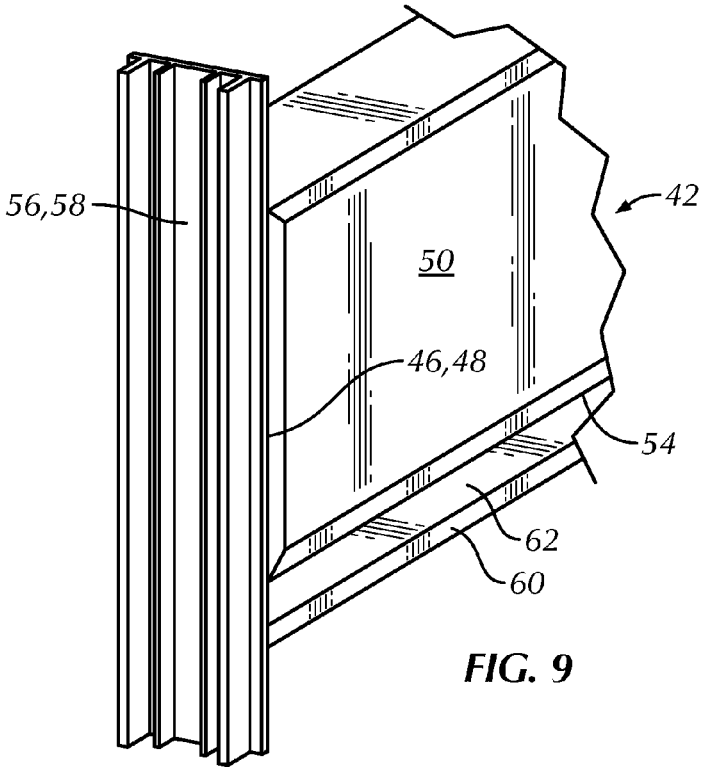
FIG. 9 is a view of the sliding unit with a sliding member.

An essential aspect of the invention relates to the formation of a base module 40, which consists of the interacting sliding top unit 42 and pivoting bottom unit 44 of the display. The top unit 42 is guided and supported in its sliding motion within the operational space by the sliding mechanism 32. One of the functions of the sliding unit 42 is to lock and release the respective pivoting unit 44. The sliding unit 42 is typically formed by at least two side walls 46, 48 interconnected by the front 50 and rear walls and supported by the bottom wall 54. As illustrated in FIG. 9, sliding members 56, 58 are connected to the respective side walls 46, 48 and are adapted for slidable engagement with the rails 34 of the sliding mechanism positioned within the interior of the side columns 12, 14. At least the front 50 and rear walls can be used for displaying advertisement materials and messages.

A longitudinal wall 60 is spaced from the bottom wall 54 of the sliding unit 42 forming a hollow utility passage or air pocket 62 therebetween. The passage 62 is provided to allow a wind to pass through. This enables the invention to withstand heavy wind forces acting on the display. In the embodiment with the multiple base modules 40, 41 (see FIG. 1 for example), there are numerous utility passages 62 formed, one in each sliding unit of the advertisement display, so that it can withstand substantial pressure generated by the wind forces.

Figure 5:
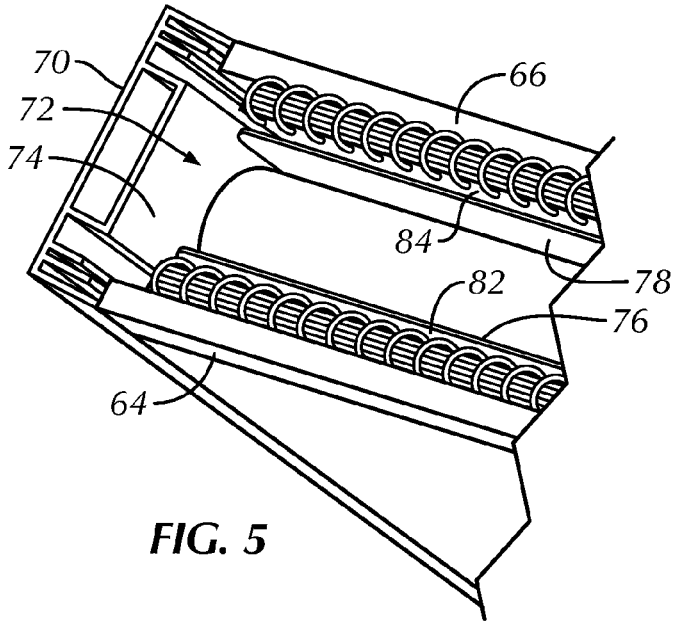
FIG. 5 shows an enlarged view of a detail 5 of FIG. 4, which is a partial view of the pivoting unit in a pivoted condition.
Figure 6:
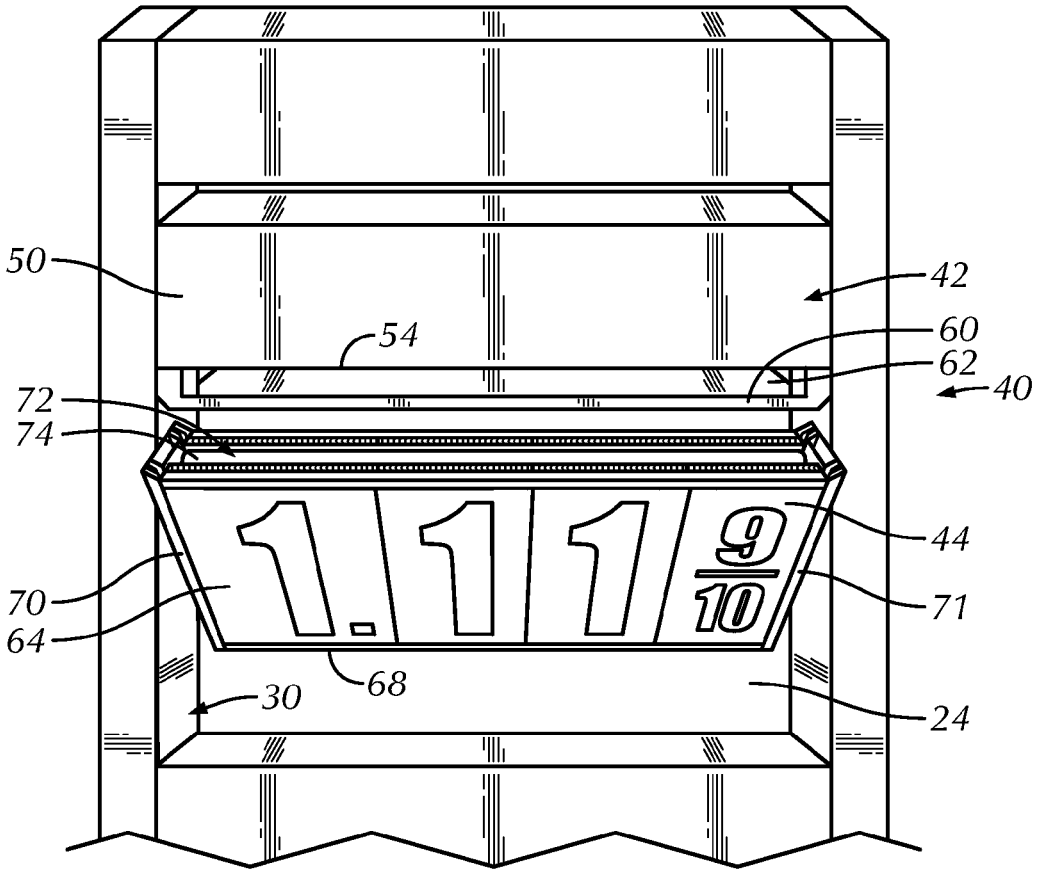
FIG. 6 is a semi-perspective view of the display showing the pivoting unit in the pivoted condition.

The pivoting unit 44 is constructed having front 64 and rear 66 exterior panels, bottom panels 68 and two side panels 70, 71 connected to each other to form a hollow interior enclosure 74 with an open upper area 72. As best illustrated in FIG. 5, front and rear interior panels 76 and 78 are positioned within the interior enclosure 74 behind the exterior panels 64, 66 forming respective hollow spaces 82, 84 therebetween. To enhance visibility of advertisements, in one of the embodiments, the front and rear panels 64, 65 are formed from a transparent material. Advertisement materials can be inserted into the hollow spaces 82, 84 between the exterior and interior panels.

The structure of the bottom pivoting unit 44 is not provided with a pivoting upper wall. The pivoting unit 44 is formed having the open upper area 72, which makes the interior enclosure 74 to be accessible to a user. In one embodiment of the invention, the hollow space between the interior panels 76 and 78 can be utilized for storing various items including advertisement materials usable with the display 10. In operation the longitudinal wall 60 of the sliding unit 42 serves as a closure of the pivoting 44 unit and is not pivoted with the pivoting unit. As illustrated by the arrows A A in FIG. 2, when the pivoting unit 44 is substantially vertically oriented and aligned within the operational space 24 defined by the side columns 12, 14, the sliding unit 42 can be slid or moved downwardly, so as to position the longitudinal wall 60 on top of the pivoting unit 44. In this manner, the longitudinal wall 60 engages the open upper area 72 and closes the enclosure 74. This action locks the pivoting unit 44 in the vertical position and prevents unauthorized access to the interior enclosure 74.

Figure 7:
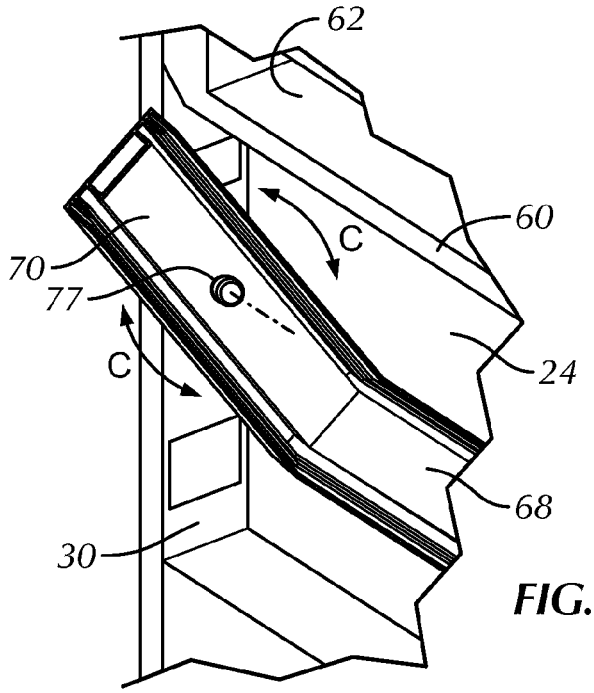
FIG. 7 is a partial perspective view showing the pivoting unit (without exterior panels) in the pivoted condition.

Once the sliding unit 42 is slid upwardly (see the arrows BB in FIG. 3), it releases the longitudinal wall 62 from its engagement with the upper area 72 of the pivoting unit positioned below. At that point the pivoting unit 44 is unlocked and can be pivoted relative to the side columns 12 and 14 (see arrows CC in FIG. 7). In this position, the access to the enclosure 74 of the pivoting unit is simplified and advertisement materials can be manipulated by an operator. For example, such materials can be inserted into the hollow spaces 82, 84 between the exterior and interior panels.

Once adjustment of the advertising items within the pivoting unit has been completed, the top unit 42 is slid downwardly in the direction of the Arrows AA, until engagement of the longitudinal wall 60 with the open upper area 72 of the pivoting unit is taken place and both units are interlocked.

According to the method of the invention the base module 40 is provided with the slidable top unit 42 and the pivoting bottom unit 44, wherein the longitudinal wall 60 of the pivoting unit slides longitudinally along the side columns 12, 14 and serving as the top portion and locking structure for the bottom pivoting unit 44. In this manner, the longitudinal wall 60 in its lower position locks and closes the enclosure 74 of the pivoting unit, when it is vertically oriented within the operational space 24 of the display. In order for the step of pivoting to occur, the sliding unit 42 with the longitudinal wall 58 is slid upwardly. Thus, in operation of the display 10 of the invention, the bottom unit 44 of the module 40 is locked and prevented from pivoting, when the top unit is slid downwardly. The bottom unit 44 is allowed to pivot about the pivoting member 77, according to the arrows CC (see FIG. 7), when the top unit 42 is slid upwardly, unlocking the bottom unit.

Figure 8:
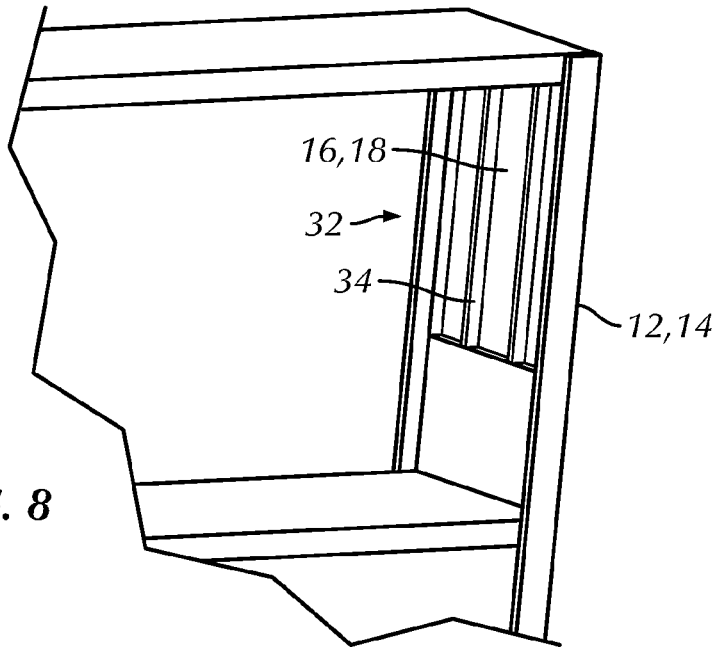
FIG. 8 is a view showing a sliding rail of a sliding mechanism positioned within a side column.

The sliding mechanism 30 is best illustrated in FIGS. 8 and 9 and consists of a guiding rail 32 which is positioned within the interior 16,18 of the side columns 12, 14. The other elements of the sliding mechanism are the sliders 56, 58 which are attached to the side walls 46, 48 of the top sliding unit of each module.

In one embodiment of the invention, an exterior of the side columns 12, 14 has an aerodynamic shape enabling the display to better withstand heavy winds. The hollow interior of the side columns is adapted to accommodate a sliding mechanism 32 provided for guiding a sliding motion of a top unit 42 of a base module with respect to the side columns 12, 14. It is illustrated in FIG. 8 that one element of the sliding pair forming the sliding mechanism 30 is a sliding rail 34 positioned within the interior of the side columns. As shown in FIG. 9, the other element of the sliding pair are the sliders 56,58 which are attached to the side walls 46,48 of the top sliding unit 42 of each base module 40. Although a specific sliding mechanism has been described, it should be obvious to a person of ordinary skill in the present art that use of any conventional sliding The upper or crown unit 20 is provided at the top of the display 10 is fixedly attached to the side columns 12, 14. The crown unit 20 is typically adapted to display brand names of advertisers or other advertisement messages. The crown unit 20 is fixedly disposed within the display 10 and remains at the predetermined top location of the display 10.

Figure 10:
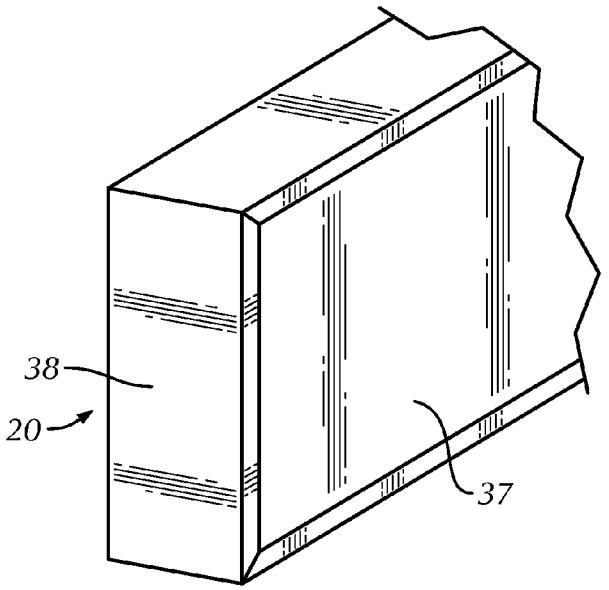
FIG. 10 is a schematic view showing a crown unit.

The typical crown unit 20 (see FIG. 10) has a box-shaped configuration with substantially hollow interior. The front and rear walls 37 can be used for displaying advertising materials. The side walls 38 of the crown unit are adapted for close engagement with the inner spaces of the side columns 12, 14. The side walls 38 of the crown unit conceal and protect the sliding mechanism 32 disposed within an inner space of the side columns which is susceptible to dust, etc. Thus, in the assembled condition, the crown unit 20 is installed in such a manner, so as to prevent dust or other undesirable particles from penetrating into the sliding mechanism 32, simplifying maintenance of the display of the invention.

The bottom unit 22 is provided for further securing the columns 12, 14 of the display. The unit 22 is fixedly positioned within the display assembly and is used to display advertisement. The general idea of having the crown 20 and bottom 22 units is to provide additional support to the side outer columns.

Although, the advertisement display has been described with at least one or single module 40 consisting of the sliding 42 and pivoting 44 units, it should be obvious to a person skilled in the art that the advertisement display with multiple modules 40,41 positioned within the operational space, is clearly within the scope of the invention. Such multiple modules are illustrated in the drawings and are adapted for displaying advertisement materials for a single or multiple products.

The advertisement display of the invention is a free standing product. It can be used in parking lots, curbside, in a mall, for any other places where the product is shown. In traditional signs, special arrangements are provided at the bottom of the sign, to resist against the wind. These arrangements are in the form of a spring loaded bottom or a reinforced bottom that can stand against the wind. Some of these arrangements have mesh holes for the wind to pass through (if springs cannot be mounted). To resist against wind, the invention is formed with the air pockets or passages 56 in each module. Such passages provide sufficient resistant against winds up to about 60-65 mph. As an additional feature, the display of the invention can be provided with holes at the bottom of the bases, so the consumer can drive a lawn steak and secure the display to the lawn. Separate wheels can be attached to one end of the display, where the consumer can tilt it and bring the display into a safe location, should it be required to be transported indoors.

The main aspect of the invention of display is versatility, value to the consumer, and full control in terms of changing advertising materials. The modules of the display are locked to each other, so as to prevent unauthorized accessing the displayed items. In the display of the invention, all advertising materials, including item numbers are secured inside of the locked pivoting unit or a cabinet. The sign can be accessed from either side to change the numbers.

In one embodiment, individual letters, words or other alpha-numeric information is removable and changeable manually by the operator. In another embodiment, an electronic arrangement is provided, so that all of the individual letters or all of the alpha-numeric information on the display are generated and changed electronically. In still another embodiment, a computer is provided so that, all of the individual letters or all of the alpha-numeric information on the display are computer generated.

According to the invention, the operator can easily change the product ID without substantial time consuming manipulations. The previously used panels are removed and stored for future use. The display of the invention is not limited to gas prices only. It is designed for a variety of applications. In view of the versatility, the invention of the display can be used as a price sign, an architectural sign, for a mall, or a store. A variety of messages can be displayed at a movie theatre or whatever a consumer demands in terms of advertising.

An essential aspect of the invention is that the display sign is modularly made, and each has different modules for each section. Therefore, all the modules can be changed in a secure and locked in a section of cabinet. Such sections can hold price booklets and mainly the holder modules can hold price booklets and PID (product identification) that other small modules can hold messages. Each display can be eventually converted into internally lit sign a new product. In the display of the invention advertising panels can be formed as internally illuminated structures with electrical components that are illuminated from inside. The signs and numbers of the display can be illuminated as well. The display of the invention enables an operator to conveniently change advertisement messages. This is because the modules displaying advertisements and containing required materials are removable. The entire product has no visual fasteners. The invention provides a modulated display with advertisement modules that can be ordered with predetermined colors at any given time and replaced. The display of the present invention is adapted to accommodate heavy winds directed transversely to its front or rear faces. This is accomplished by means of the hollow utility passages or air pockets formed in the sliding unit of each module for the wind to pass through.

What is claimed is:

1. An advertisement display comprising:

first and second side columns spaced from each other defining an operational space therebetween, at least one advertisement module provided within the operational space, said module being formed having a sliding top unit and a pivoting bottom unit, said top unit is adapted for slidable movement within the operational space and is formed with front, rear and side walls supported by a bottom wall;

the pivoting bottom unit formed by at least front and rear exterior panels interconnected by first and second side panels and supported by a bottom panel, so as to form an open upper area;

the sliding top unit is slidably movable with the operational spaces along said side columns, so as to engage and disengage the pivoting unit;

in a downward position the top unit engages and locks the pivoting unit when it is substantially vertically oriented within the operational space, and for the pivoting to occur the pivoting unit is unlocked by moving the sliding unit upwardly from said engaged downward position.

2. The advertisement display of claim 1, wherein the top sliding unit further comprises a longitudinal wall spaced from the bottom wall, so as to define a utility space therebetween; the longitudinal wall is movable with the top unit within the operational spaces, wherein the longitudinal wall in the downward position of the top unit engages the open upper area, preventing of the bottom pivoting unit, and for the pivoting to occur the bottom unit is released by moving the longitudinal wall upwardly.

3. The advertisement display of claim 1, wherein the at least one advertisement module comprises multiple advertisement modules provided within the operational space.

4. The advertisement display of claim 1, further comprising a sliding mechanism including a sliding rail positioned within an interior of the side columns and sliders associated with the side walls of the top sliding unit and adapted for slidable engagement with the sliding rail.

5. The advertisement display of claim 4, wherein pivot members extend outwardly from each said side panel, said pivot members are associated with the side columns to facilitate pivoting motion of the pivoting unit.

6. The advertisement display of claim 1, wherein the said panels form a hollow interior of the pivoting unit.

7. The advertisement display of claim 6, wherein said pivoting unit further comprises a first and second interior panels provided within said hollow interior of the pivoting unit, said interior panels are being spaced from the respective exterior panels, so as to form hollow receiving spaces adapted for receiving and displaying advertising materials.

8. The advertisement display of claim 1, further comprising upper and lower units interconnected by the side columns, said upper and lower units are separated by said at least one advertisement module.

9. The advertisement display of claim 8, wherein said exterior panels are made from a transparent material to facilitate displaying advertisement materials disposed within said hollow receiving spaces.

10. A method of operation of an advertisement display, said display comprising: first and second side columns spaced from each other defining an operational space therebetween; at least one advertisement module provided within the operational space, said module comprises a sliding top unit and a pivoting bottom unit, said top unit is adapted for slidable movement within the operational space and is formed by at least front and rear walls supported by a bottom wall; the pivoting bottom unit is formed by at least front and rear exterior panels interconnected by first and second side panels defining an open upper area; said method comprising the steps of:

sliding said top unit within the operational space longitudinally along said first and second columns;

pivoting said bottom unit relative to said first and second side columns;

wherein upon sliding the top unit to its lower position within the operational space it engages the open upper area of the bottom unit, so as to engage the pivoting unit and to prevent pivotal motion thereof relative to the side columns; and upon sliding motion of the top unit in the upward direction it disengages the open upper area of the bottom unit, so as to facilitate the pivotal motion of the bottom unit relative the side columns.

11. The method according to claim 10, wherein in said top unit further comprises a longitudinal wall spaced from the bottom wall, so as to define a utility space therebetween; wherein, in said step of sliding upon the top unit being slid to the lower position thereof, the longitudinal wall engages the open upper area of the bottom unit.

12. The method according to claim 11, wherein and in said step of sliding upon the top unit being slid in the upward direction, the longitudinal wall disengages the open upper area of the bottom unit, so as to facilitate said step of pivoting.

13. The method according to claim 12, wherein in said step of pivoting said pivoting bottom unit is pivoted to a vertical position, so as to be aligned with the side columns.

14. The method according to claim 13, wherein to facilitate engagement between the longitudinal wall and the upper area of the pivoting unit; said bottom unit is substantially vertically aligned within said columns.

15. The method according to claim 14, wherein the top unit and the bottom unit are substantially vertically aligned for disengagement between the longitudinal wall and the upper area of the pivoting unit.

* * * * *